US010342742B2

(12) United States Patent
Ruda

(10) Patent No.: US 10,342,742 B2
(45) Date of Patent: Jul. 9, 2019

(54) BOLUS FEEDING DEVICE

(71) Applicant: Kenneth Edward Ruda, Alameda, CA (US)

(72) Inventor: Kenneth Edward Ruda, Alameda, CA (US)

( * ) Notice: Subject to any disclaimer, the term of this patent is extended or adjusted under 35 U.S.C. 154(b) by 382 days.

(21) Appl. No.: 14/680,686

(22) Filed: Apr. 7, 2015

(65) Prior Publication Data

US 2016/0296423 A1 Oct. 13, 2016

(51) Int. Cl.
*A61J 15/00* (2006.01)

(52) U.S. Cl.
CPC ..... *A61J 15/0015* (2013.01); *A61J 15/0076* (2015.05)

(58) Field of Classification Search
CPC .... A61M 5/20; A61M 35/003; A61M 5/2053; A61M 5/1782; A61M 5/24; A61M 5/31581; A61M 2202/0482; A61M 2202/0468; A61M 2202/04; A61C 19/063; A61J 11/0005; A61J 15/00; A61J 15/0003; A61J 15/0011; A61J 7/0053; A61J 15/0015; A61J 15/0026; A61J 15/0076

See application file for complete search history.

(56) References Cited

U.S. PATENT DOCUMENTS 2,748,767 A * 6/1956 Wright ..... A61C 9/0026 604/209
3,016,897 A * 1/1962 Kendrick ..... A61M 5/19 42/106
3,110,310 A * 11/1963 Cislak ..... A61M 5/31581 604/209
3,141,583 A * 7/1964 Mapel ..... A61C 9/0026 222/309
3,319,839 A * 5/1967 Cox ..... A61D 7/00 222/327
3,402,712 A * 9/1968 Eisenhand ..... A61M 37/0069 221/19
3,774,607 A * 11/1973 Schmitz ..... A61M 37/0069 604/61

(Continued)

FOREIGN PATENT DOCUMENTS

GB 2143605 A * 2/1985 ..... F16L 27/0828

OTHER PUBLICATIONS

"Applied Medical Technology, Inc." 2014. Accessed online: <http://www.appliedmedical.net/wp-content/uploads/2014/12/ENFit-Gatefold_AMT.pdf>.*

*Primary Examiner* — Scott J Medway
(74) *Attorney, Agent, or Firm* — Kafantaris Law Offices; Theo Kafantaris

(57) ABSTRACT

A bolus feeding device is disclosed that provides for more effective and convenient G-Tube feeding. The device includes a chassis that houses a chamber for storing the bolus, a trigger-piston assembly for compressing the bolus, a chamber hatch for accessing the chamber, and a dispensing unit for transferring the bolus into a G-Tube. The dispensing unit includes a port connector that connects to an enteral feeding system. The dispensing unit is configured to allow the port connector to rotate about the vertical and horizontal axes in order to minimize twisting, kinking or pulling of the G-Tube during feeding. The device also includes a collapsible funnel unit that reversibly attaches to the device for enhanced filling of the chamber.

15 Claims, 11 Drawing Sheets

(56) References Cited

U.S. PATENT DOCUMENTS 4,105,030 A * 8/1978 Kercso ..... A61M 37/0069 604/506
4,659,326 A * 4/1987 Johnson ..... A61M 37/0069 604/62
5,135,493 A * 8/1992 Peschke ..... A61M 37/0069 604/57
5,147,295 A * 9/1992 Stewart ..... A61M 37/0069 604/61
5,300,029 A * 4/1994 Denance ..... A61M 5/20 128/DIG. 1
5,376,072 A * 12/1994 Klearman ..... A61J 7/0007 604/218
5,464,393 A * 11/1995 Klearman ..... A61J 7/0007 241/DIG. 27
5,692,642 A * 12/1997 Brattesani ..... A61C 5/62 221/199
5,743,431 A * 4/1998 Brattesani ..... A61C 5/62 222/1
5,840,065 A * 11/1998 Goldhardt ..... A61J 15/0015 604/170.03
5,997,485 A * 12/1999 Ahmadzadeh ..... A61B 17/3403 600/567
6,053,889 A * 4/2000 Heinzen ..... C12M 35/00 604/24
6,135,983 A * 10/2000 Andrews ..... A61J 1/16 604/257
D545,622 S * 7/2007 Gomez ..... A61J 7/0007 D24/220
7,611,502 B2 * 11/2009 Daly ..... A61J 1/1481 215/247
7,632,251 B2 * 12/2009 Lin ..... A61M 5/24 222/144
D645,140 S * 9/2011 Peuker ..... D24/114
8,647,115 B2 * 2/2014 Boehm ..... A61C 9/0026 433/90
9,656,022 B1 * 5/2017 Russo ..... A61M 5/2448
2005/0085767 A1 * 4/2005 Menassa ..... A61M 5/30 604/68
2005/0165368 A1 * 7/2005 Py ..... A61F 9/0008 604/289
2007/0048688 A1 * 3/2007 Pauser ..... B05C 17/00593 433/90
2007/0060898 A1 * 3/2007 Shaughnessy ..... A61M 39/10 604/284
2008/0140020 A1 * 6/2008 Shirley ..... A61M 39/10 604/240
2009/0299336 A1 * 12/2009 Jay-Robinson .... A61B 1/00137 604/533
2010/0145283 A1 * 6/2010 Walker ..... A61D 7/00 604/192
2011/0087193 A1 * 4/2011 Hyun ..... A61J 9/00 604/514
2012/0232524 A1 * 9/2012 Hyun ..... A61M 5/385 604/514

* cited by examiner

BOLUS FEEDING DEVICE

RELATED U.S. APPLICATION DATA

This application claims priority to Provisional Application No. 62/103,225, filed Jan. 14, 2015.

FIELD OF THE INVENTION

The present invention relates to devices for facilitating the feeding of a bolus to individuals via a gastrostomy tube.

BACKGROUND

For many, enteral tube feeding is a necessary last resort for meeting basic nutritional needs. It is a common practice for those requiring home tube feeding via a gastrostomy tube, or G-Tube, to depend on a feeding procedure carried out by a caregiver, with four to seven feeding sessions a day. This practice is referred to as bolus feeding. There are two common delivery methods for bolus delivery: gravity gavage and syringe depression ("push-method"). Both of these methods currently use identical medical equipment and suffer from numerous disadvantages. The experience of assisted G-Tube feeding involves a cumbersome, often messy technique of pouring a fluid bolus into a syringe and channeling the bolus/fluid into a tube that is connected to the patient using standardized connective components. Both methods typically use limited capacity 60 ml irrigation syringes (2 oz.). The current syringes need to be refilled 5-6 times during a feeding session in order to deliver the requisite bolus volume, with even more refills for the greater caloric needs of adults. The current G-Tube feeding experience is often very demanding for the caregiver due to a poor ergonomic configuration. In particular, the caregiver commonly suffers joint injury (e.g., carpometacarpal or ulnocarpal joint injury) from the repeated motion of holding the syringe while manipulating the plunger. The current process lacks the necessary flexibility, control, and ergonomics necessary to prevent repetitive stress injuries.

The problem of food spillage during syringe filling is a common and unpleasant aspect of the feeding process. Moreover, the repeated twisting or kinking of the G-Tube can impede bolus flow, damage equipment or cause disengagement of the G-Tube from the syringe or the patient. Importantly, the patient currently suffers the consequences of poor movement stabilization at the G-Tube connection site because they feel every movement from the caregiver as they try to remain stationary. This unavoidable movement often leads to skin irritation and early G-Tube failures. In short, current methods generally require cumbersome manipulation, cause joint injury, and are prone to messy accidents that diminish the quality of life for both the patient and caregiver. There is a need in the art for an alternative method of enteral tube feeding, one that is more convenient, controlled, and reduces the number of requisite devices and steps for feeding.

SUMMARY

A bolus feeding device is disclosed that provides for more effective and convenient G-Tube feeding. The device includes a chassis that houses a chamber for storing the bolus, a trigger-piston assembly for compressing the bolus, a chamber hatch for accessing the chamber, and a dispensing unit for transferring the bolus into a G-Tube. The dispensing unit includes a port connector that connects to an enteral feeding system. The dispensing unit is configured to allow the port connector to rotate about the vertical and horizontal axes in order to minimize twisting, kinking or pulling of the G-Tube during feeding. The device also includes a collapsible funnel unit that reversibly attaches to the device for enhanced filling of the chamber.

DETAILED DESCRIPTION

Figure 1:
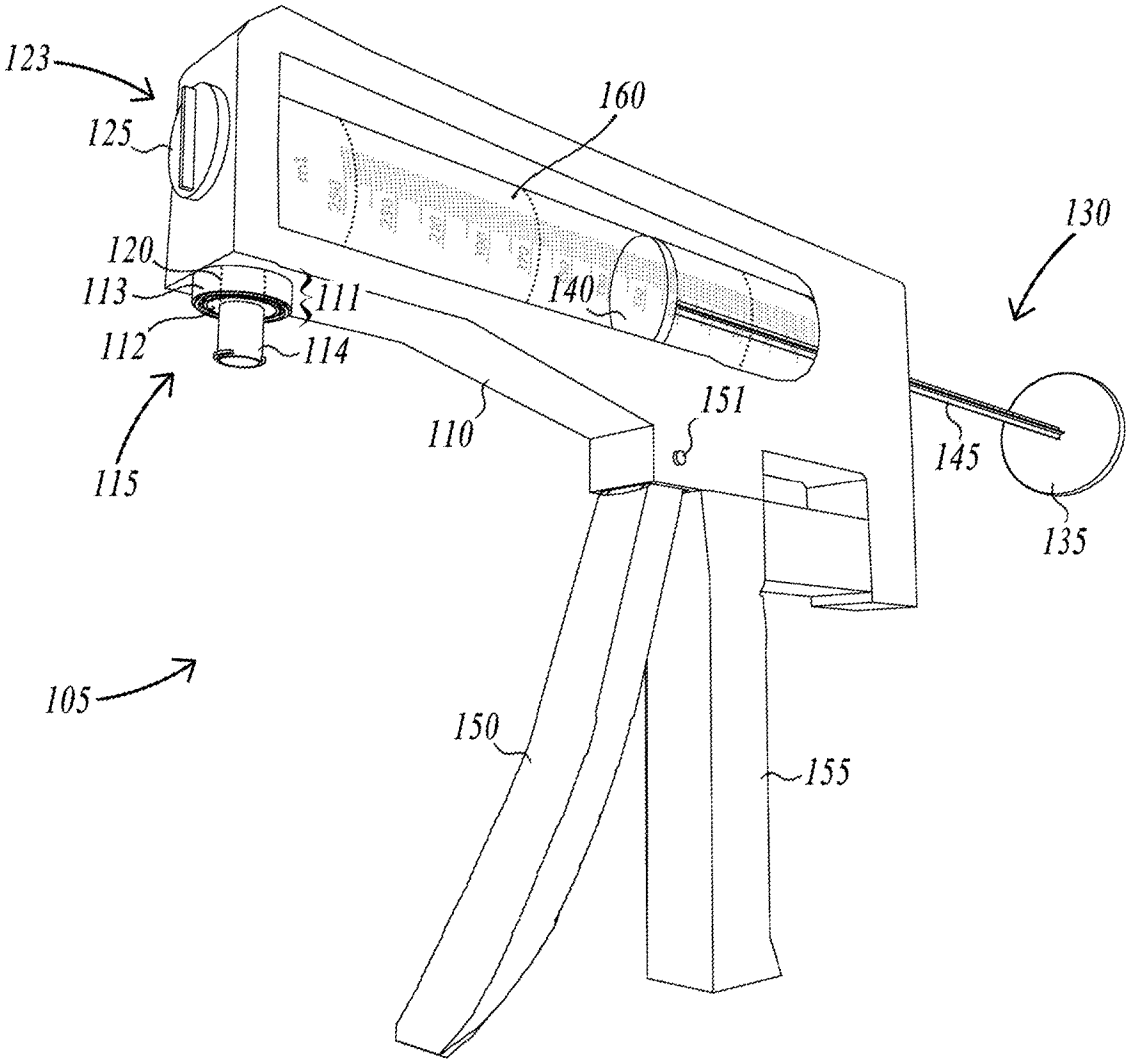
FIG. 1 illustrates a perspective frontal view of the bolus feeding device.

FIG. 1 illustrates a perspective frontal view of the bolus feeding device of the present invention. As used herein, the terms "bolus" and "formula" will be used interchangeably to refer to a liquid food substance. The bolus feeding device 105 includes a chassis 110 that provides a central framework for the device. The device further comprises a chamber 160, a chamber piston 130, a chamber hatch 823, a dispensing unit 115, a trigger 150, and a grip handle 155. The chamber cap 125 and chamber hole (see chamber hole 224 of FIG. 2) are collectively referred to as the chamber hatch 823. The general structure and function of the device is like that of a gun, having components that resemble a handle, a trigger, and a barrel. As shown, the chassis has a horizontal bottom surface from which the trigger 150 and grip handle 155 extend, a vertical distal surface having a chamber cap 125, a vertical proximal surface engaged with piston 130, and a horizontal top surface. The chamber piston 130 provides for a syringe-style compression of liquid (e.g., food formula or bolus) within the chamber 160. The chamber piston 130 comprises a plunger rod 145, plunger base 135, and plunger tip 140 which makes contact with the formula during compression. The chamber piston 130 is slidably engaged with the chamber 160, wherein the diameter of the plunger tip 140 is approximately equal to the inner diameter of the chamber 160 such that the plunger tip 140 maintains a liquid seal as it moves within the chamber 160. This piston-chamber action is comparable to a syringe used to compress and eject fluids. The dispensing channel 120 connects the chamber 160 to the dispensing unit 115. The dispensing unit 115 further comprises a port connector 114 and a rotation element 111 with outer ring 113 and inner ring 112. In an exemplary embodiment, the port connector 114 is a standard ENFit connector that connects to a standard G-Tube port as shown and described in connection with FIG. 7. As such, the device is configured to work with standard enteral systems.

The chamber 160 and dispensing unit 115 are joined via a dispensing channel (see dispensing channel 220 of FIG. 2), which is a short channel that leads from the chamber 160, through the chassis 110, and to the dispensing unit. The chamber 160 may be made of glass, high grade plastic, or comparable material that is suitable for holding consumable fluids (e.g. medical grade plastics). As indicated by the volumetric measure markings on the chamber 160, the chamber volume is 250 ml in the exemplary embodiment depicted in the Figures. This chamber volume may be ideal for children and adolescents, whereas a somewhat larger volume such as 300 ml may be ideal for adults while not creating a device that is too large or heavy. Thus, the chamber 160 has a volume that is substantially greater than the conventional 60 ml syringe. This eliminates the time and effort associated with repeated syringe filling, and provides a device that can storage and readily dispense a relatively large volume of bolus. Once the chamber 160 is filled, the contents can be dispensed as desired, either all at once or over a period of time for multiple feeding sessions. In order to expel formula from the chamber 160, a user applies pressure to the trigger 150 in the direction of grip handle 155. Said pressure causes the forward motion of the piston 130, toward the chamber cap 125. This motion forces formula between the plunger tip 140 and chamber cap 125 to travel through the dispensing channel and into the inner ring 112 which opens into the port connector 114. Thus, trigger compression results in formula expulsion out of the dispensing unit 115. This figure shows the trigger 150 in a fully decompressed position. It pivots at the point of an axle 151, and can affect the piston 130 via ratchet mechanisms, a pressure rod, or similar mechanism as known in the art. Consecutive trigger compressions are required to expel the full contents of the chamber 160. An advantage of this is a slow, controlled expulsion of chamber contents. Gripping the grip handle 155 while compressing the trigger 150 allows for a comfortable ergonomic experience, making extended usage more pleasant for the user, as compared with conventional tube feeding methods. In particular, the user is able use a natural grip to hold and deliver the bolus during feeding with only one hand, rather than use both hands to hold and manipulate a syringe as is conventional. The manipulation of a syringe is more cumbersome, and less ergonomic, that a gun-like device of the present invention.

Figure 7:
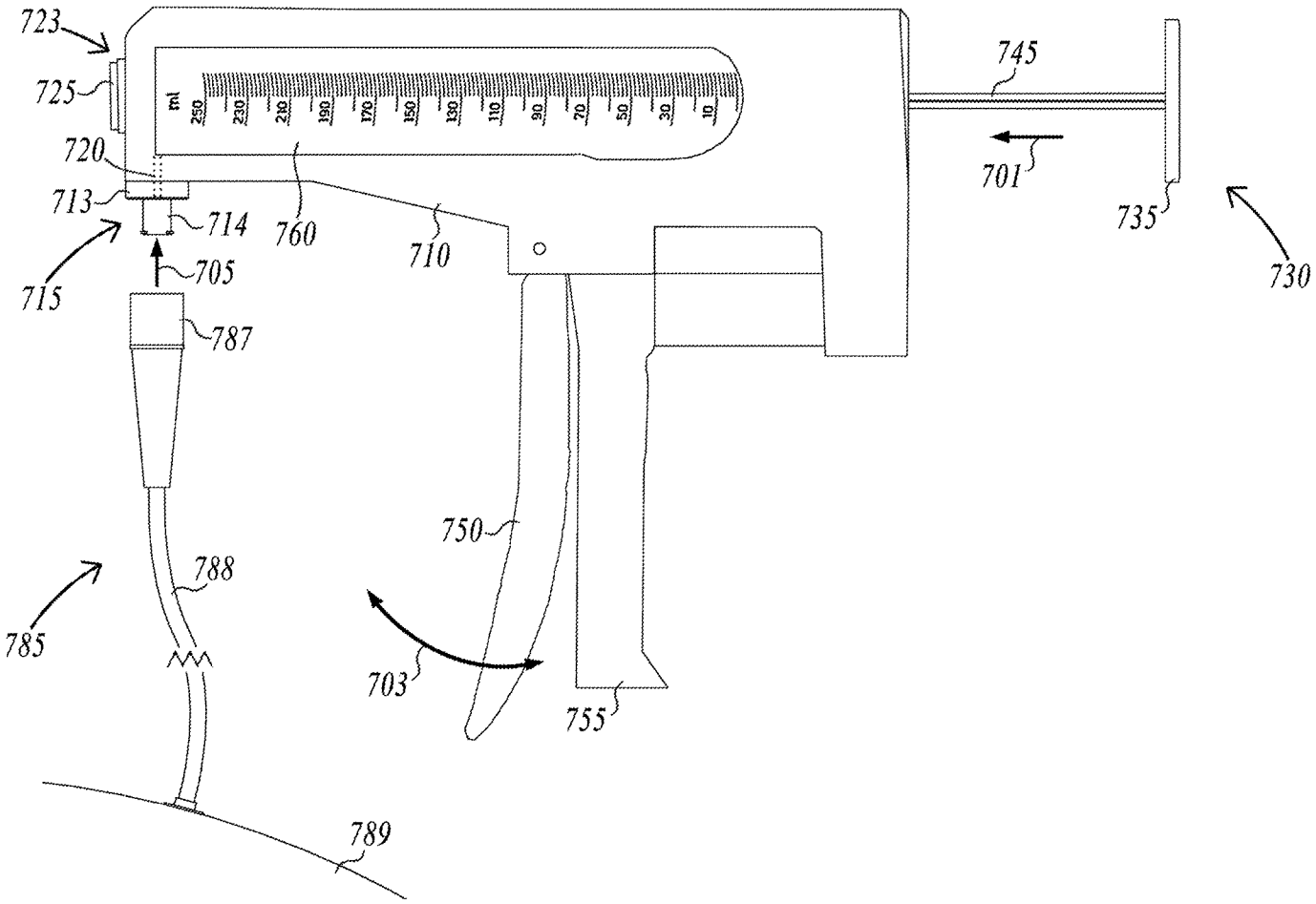
FIG. 7 illustrates a side view of gastrostomy tube connectivity to the bolus feeding device.

Another important advantage of the preferred embodiment of the device results from the relative orientation of the chamber 160, chamber hatch 123, and the dispensing unit 115. Specifically, the chamber hatch 123 is positioned where one would normally find the exit point of the chamber such as the nozzle on a drench gun. However, the present device places the chamber opening at the end of the chamber, so that the chamber can be easily cleaned and refilled via removal of the chamber cap. If the chamber hatch 123 were perpendicular to the chamber then it would be difficult to properly clean the inside of the chamber. Also, filling the chamber is more convenient when it is in a vertical position (i.e. when the chamber opening is aligned with the length of the chamber). At the same time, the dispensing unit 115 is pointed downward, perpendicular to the chamber, in order to more properly align with the G-Tube and reduce twisting, kinking or pulling (as shown in FIG. 7). The twisting or kinking of the G-Tube can impede the bolus flow, while the pulling of the G-Tube can cause patient discomfort or cause the disengagement of the G-Tube from the patient or the port connector. Because the bolus delivery device is usually held above the person that is feeding in order to utilize gravity in the delivery action, the downward facing dispensing unit 115 is naturally aligned with the G-Tube (as shown in FIG. 7). Conversely, if the dispensing unit was aligned with the chamber (i.e. on the vertical distal surface of the chassis), then the G-Tube would bend at a 90 degree angle before extending downward, which is undesirable as kinking of the G-Tube impedes bolus flow. Thus the orientation of the chamber hatch relative to the chamber, and the orientation of the dispensing unit relative to the chamber, are both advantageous in the present device. However, it is within the scope of the invention to position the chamber hatch and dispensing unit such that they have a different relative orientation or are positioned on different portions of the chassis from that shown in the Figures and described herein.

Figure 2:
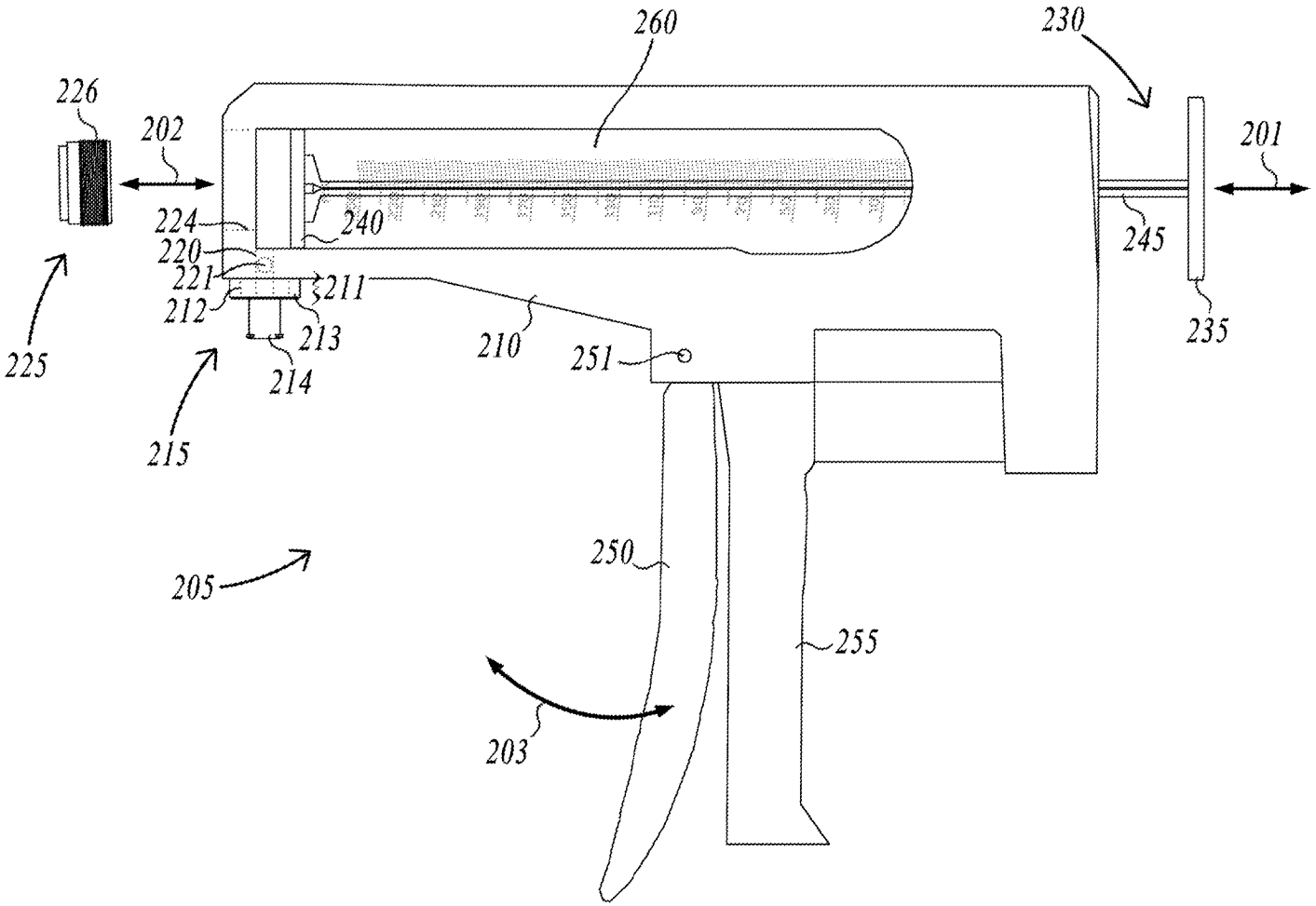
FIG. 2 illustrates a side view of the bolus feeding device with chamber cap removed.

FIG. 2 illustrates a side view of the bolus feeding device with chamber cap 225 removed from the chamber hole 224 of chamber 260. The device 205 has a chassis 210 which houses the chamber 260, within which the chamber piston 230 is compressed and decompressed. Motion arrow 201 denotes this back and forth action. The piston 230 further comprises a plunger base 235, plunger rod 245, and plunger tip 240. As shown, the piston 230 is almost fully compressed, with its tip 240 near the distal end of the chamber 260 and above the dispensing unit 215. The dispensing unit further comprises a rotation element 211 (including outer ring 213 and inner ring 212) and port connector 214. The compressive action of the trigger 250 (which pivots on axle 251) exerts pressure on the formula between the plunger tip 240 and the end of the chamber, forcing the formula into the dispensing channel 220 (outlined by dotted lines). The dispensing channel 220 directs the formula into and through the inner ring 212 which leads to port connector 214. Within the dispensing channel 220 is a flow valve 221 that regulates the flow through the dispensing channel. In a resting state, the valve is closed, but when pressure is applied from the chamber 260, the valve opens to allow flow through the dispensing channel 220 and into the dispensing unit 215. Motion arrow 203 denotes the compression/decompression of the trigger 250. This figure shows the trigger in a fully compressed position with respect to grip handle 255.

As indicated by threaded portion 226, the chamber cap 226 screws into and out of the threaded chamber hole 224 to provide an airtight seal of the chamber while allowing access when needed. As noted above, the chamber hole 224 and chamber cap 225 are collectively referred to as the chamber hatch. Motion arrow 202 denotes the removal/attachment of the chamber cap 225. The removal of chamber cap 225 allows access to the chamber for both chamber reloading (re-filling with bolus) as well as chamber cleaning. The center of the chamber cap 225 is approximately aligned with the chamber's longitudinal axis. With the chamber's opening positioned in this manner, a user may directly insert a standard cleaning utensil such as a wand or bottle cleaner to clean the chamber. This, in combination with a soap and water solution can be used to regularly cleanse the interior of the device. The chamber cap 225 may be composed of rubber or other suitable material that maximizes water/air resistance as known in the art. As mentioned previously, it may be threaded, or utilize some other connection method that maximizes the integrity of an air-tight and liquid-tight seal.

Figure 3:
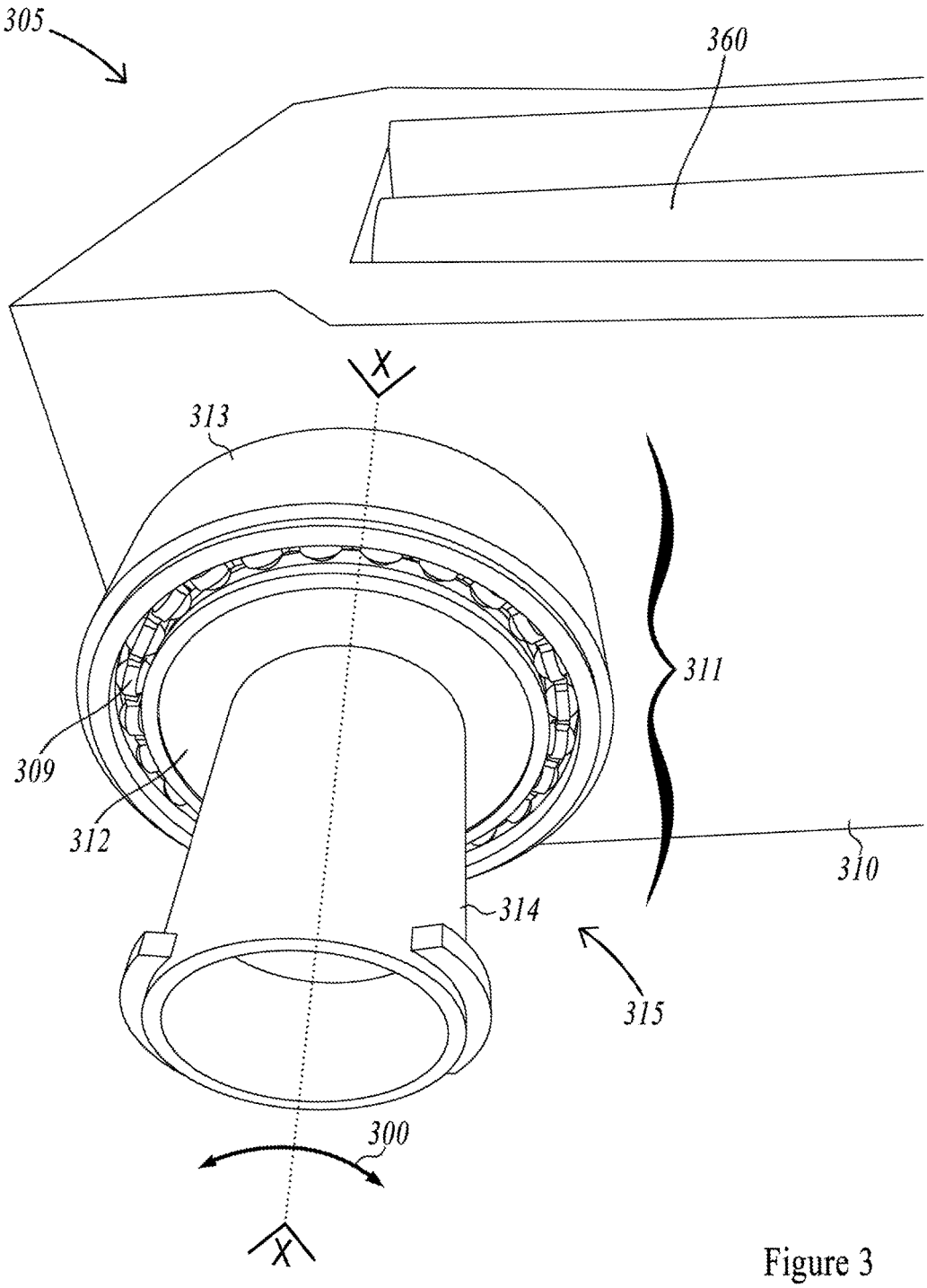
FIG. 3 illustrates a close-up bottom view of the dispensing unit terminating in a port connector.

FIG. 3 illustrates a close-up bottom view of the distal end of the device, showing the dispensing unit terminating in a port connector. The dispensing unit 315 lies directly beneath the distal or terminal end of the chamber 360, extending downward from the chassis 310. Dispensing unit 315 comprises port connector 314 and rotation element 311. In an exemplary embodiment, the port connector 314 is a standard ENFit connector that connects to a standard G-Tube port. The rotation element 311 further comprises an outer ring 313, inner ring 312, and ball/cage array 309. Essentially, the rotational element 311 allows the port connector 314 to rotate about its vertical (longitudinal) axis as denoted by motion arrow 300 around dotted line "X." The inner ring 312 meets the ball/cage array 309 on its outer circumference, while its inner circumference meets the port connector 314, the latter circumferential connection being static. Thus, as the port connector 314 experiences rotation, it simultaneously rotates the inner ring 312 within the ball/cage array 309. This rotation element enables a greater degree of stability in a feeding session, preventing G-Tube twisting. The result is a more comfortable experience for both the device operator and the patient receiving the bolus feed. For the user, unintentional movements that cause lateral rotation of the device might otherwise twist the G-Tube and interfere will flow of the bolus. The rotating port connector 315 substantially absorbs these motions, which become more likely during extended enteral feeding sessions. The patient subsequently experiences a greater degree of physical comfort and peace of mind, as they are less likely to sense any movement from their G-Tube.

Figure 4:
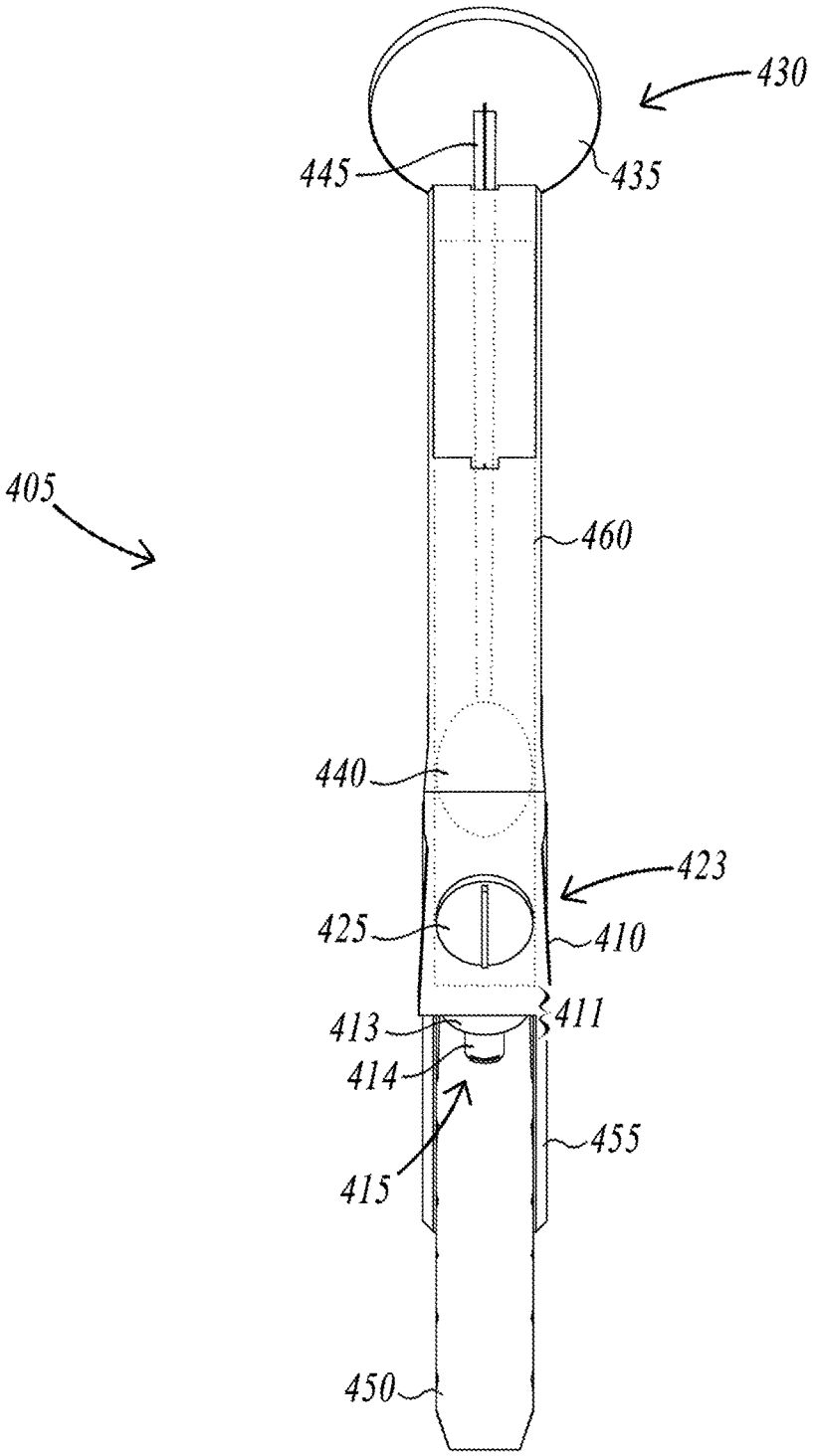
FIG. 4 illustrates an isometric front view of the bolus feeding device.

FIG. 4 illustrates an isometric front view of the bolus feeding device (i.e. the proximal end). The device 405 comprises a chassis 410, chamber hatch 423 with removable chamber cap 425, dispensing unit 415, trigger 450, grip handle 455, and chamber piston 430. The piston, partially contained within the chamber 460, extends out from the back of the chassis 410 and further comprises a plunger base 435, plunger rod 445, and plunger tip 440. The dispensing unit 415 further comprises a port connector 414 and rotation element 411 with outer ring 413.

Figure 5:
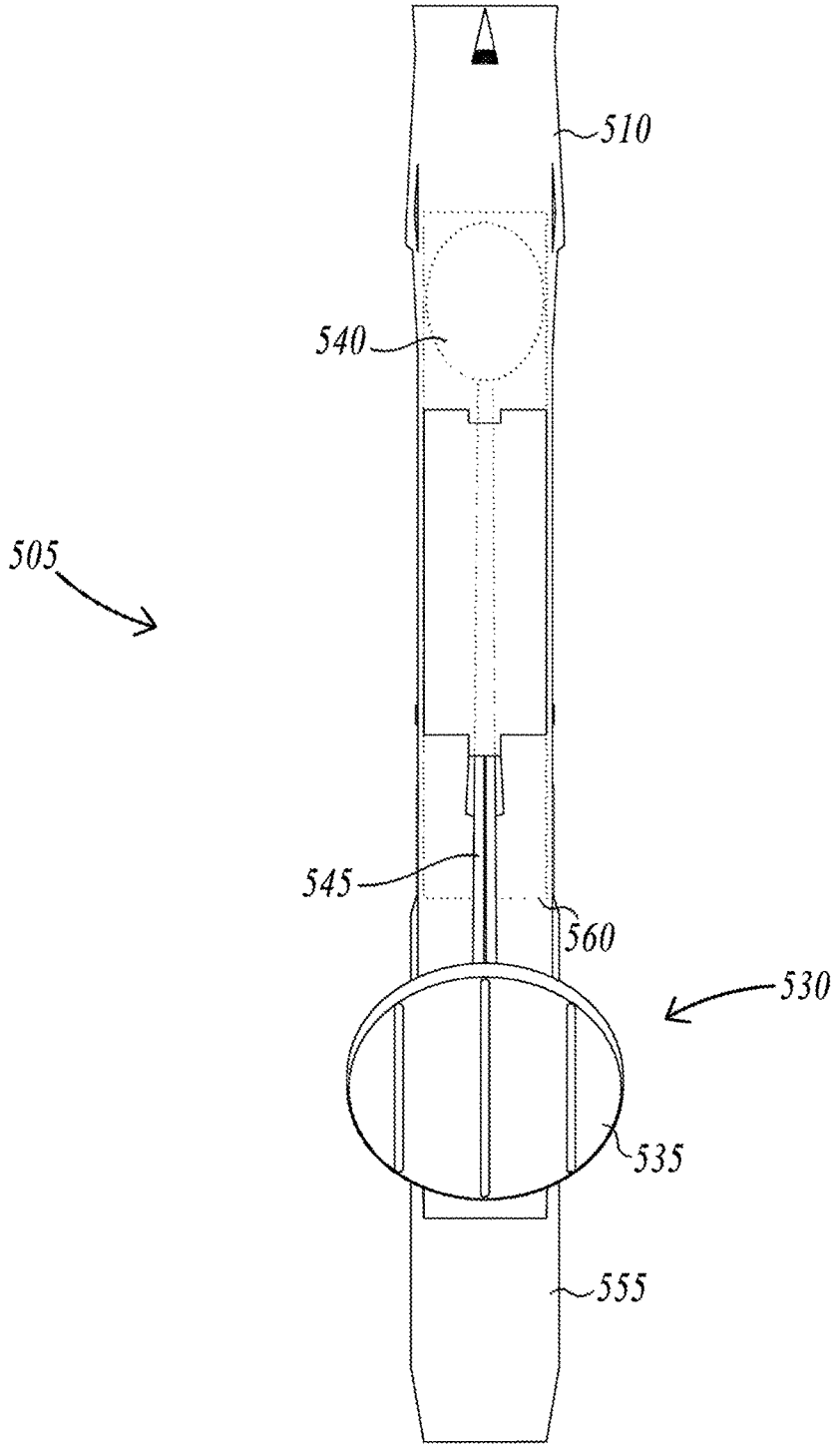
FIG. 5 illustrates an isometric rear view of the bolus feeding device.

FIG. 5 illustrates an isometric back view of the bolus feeding device (i.e. the distal end). The device 505 comprises a chassis 510 with grip handle 555 and chamber piston 530. The piston, partially contained within the chamber 560, extends out from the back of the chassis 510, further comprising a plunger base 535, plunger rod 545, and plunger tip 540. The piston 530 is again shown in a compressed state. This rear view of the device 505 shows the point at which the piston 530 exits the chassis 510 in greater detail. This portion may also consist of pressure rod elements and/or a spring element with a stopping plate to aid in piston control via methods known in the art. The resultant device provides a controlled, consistent, yet mechanically efficient method of expelling chamber contents. With this system, physical strength, or the lack thereof, does not hinder device usage in any way. The process of expelling chamber contents constantly over time, independent of the force applied to the trigger mechanism ensures safe and reliable bolus delivery.

Figure 6:
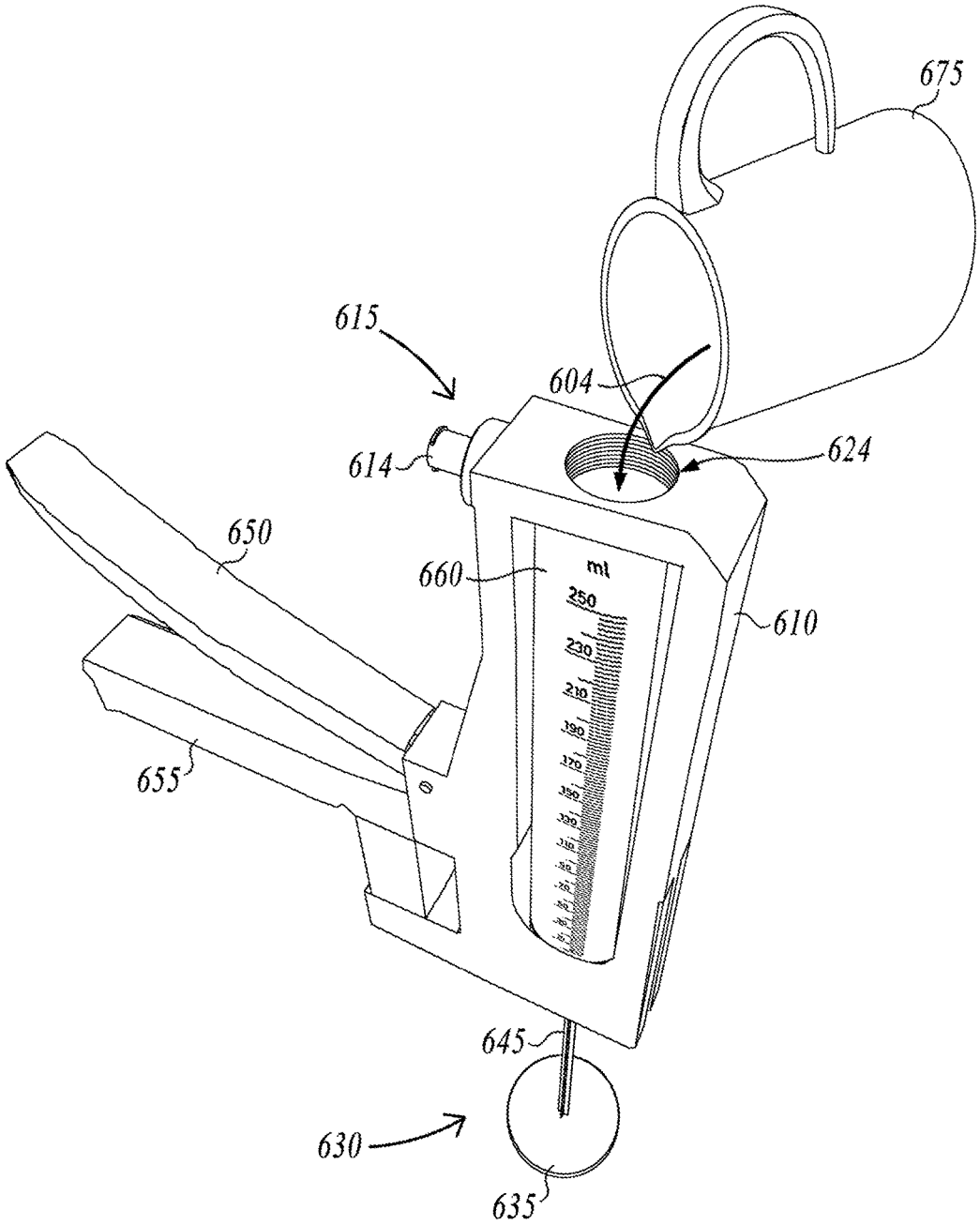
FIG. 6 illustrates a perspective view of chamber loading.

FIG. 6 illustrates a perspective view of chamber loading or filling with the bolus. With the chamber cap removed (see chamber cap 225 of FIG. 2), the user rotates the device so that the lengths of the piston 630 and chamber 660 are perpendicular to the floor, and the chamber hole 624 is facing upward. If the piston 630 is not already in a fully decompressed state, the user should complete this action by pulling the plunger base 635 backward (in a direction away from the chassis 610) until it reaches the back of the chamber 660. The majority of the plunger rod 645 should now reside outside of the chamber 660 and chassis 610. The user may then position a formula-filled container 675 over the chamber hole 624 and pour the formula into the hole, to fill the chamber 660 as desired. As shown, volumetric measurement marks on the outer surface of the chamber aid in the filling of the chamber as well as the bolus delivery. The movement of fluid into the chamber is denoted by motion arrow 604. The user may desire to prepare a pre-measured quantity of formula via the container 675, or simply measure the amount of liquid as it fills the chamber 660 via volume markings on the chamber. The elongated form of the chamber (a consequence of the device's weight-balanced, ergonomic design) provides ample space for the bolus feed. Additionally, the type of bolus feed does not affect the performance of the device. As previously stated, the device yields a consistent quantity of formula per trigger compression, regardless of the consistency, viscosity, density, etc. of the fluid. This characteristic is highly valuable in that water can just as easily be cycled through the system for cleaning/flushing purposes. At times, especially when dealing with water or low viscosity bolus fluids or topping off, it may be desirable to temporarily seal the port connector 614 to prevent unwanted outflow of fluid, such as during chamber filling. This can be achieved by a flow valve in the dispensing channel (as described in connection with FIG. 2). Alternatively, this may be achieved by a port cap, composed of vinyl or other polymer, that is preferably attached to the body of the dispensing unit 615.

FIG. 7 illustrates a side view of gastrostomy tube ("G-Tube") connectivity to the bolus feeding device. The bolus feeding device, having chamber hatch 723 with chamber cap 725 screwed into place and sealing the chamber 760 that is filled with an appropriate volume of formula, connects to the patient's enteral feeding system 785 via the port connector 714 found on the terminal portion of the dispensing unit 715. The enteral feeding system 785 comprises G-Tube port 787 and G-Tube 788, as known in the art. The port connector 714 connects into the G-Tube port 787, which leads to the patient 789 via the G-Tube 788. This connection method is indicated by motion arrow 705. With both systems properly connected, the user may proceed to dispense formula from the device. Grasping the grip handle 755, the user executes multiple compressions of the trigger 750, as shown by motion arrow 703. This action forces the chamber piston 730 forward, its plunger base 735 approaching the chassis 710 and chamber 760 with each compression. The feeding progresses until the majority of the plunger rod 745 resides inside the chamber 760. This forward piston movement is shown by motion arrow 701. Formula within the chamber 760 is compressed by the piston 730 and forced to travel downward through the dispensing channel 720, through the outer ring 713, and out through the opening in the Port connector 714. With enteral components properly connected as described above, the formula flows into the G-Tube port 787 and through the G-Tube 788, continuing on until it reaches the patient 789. As previously described, the positioning of the bolus feeding device is more versatile as a result of the 360 rotation of the port connector 714, which prevents twisting of the G-Tube 788.

Figure 8:
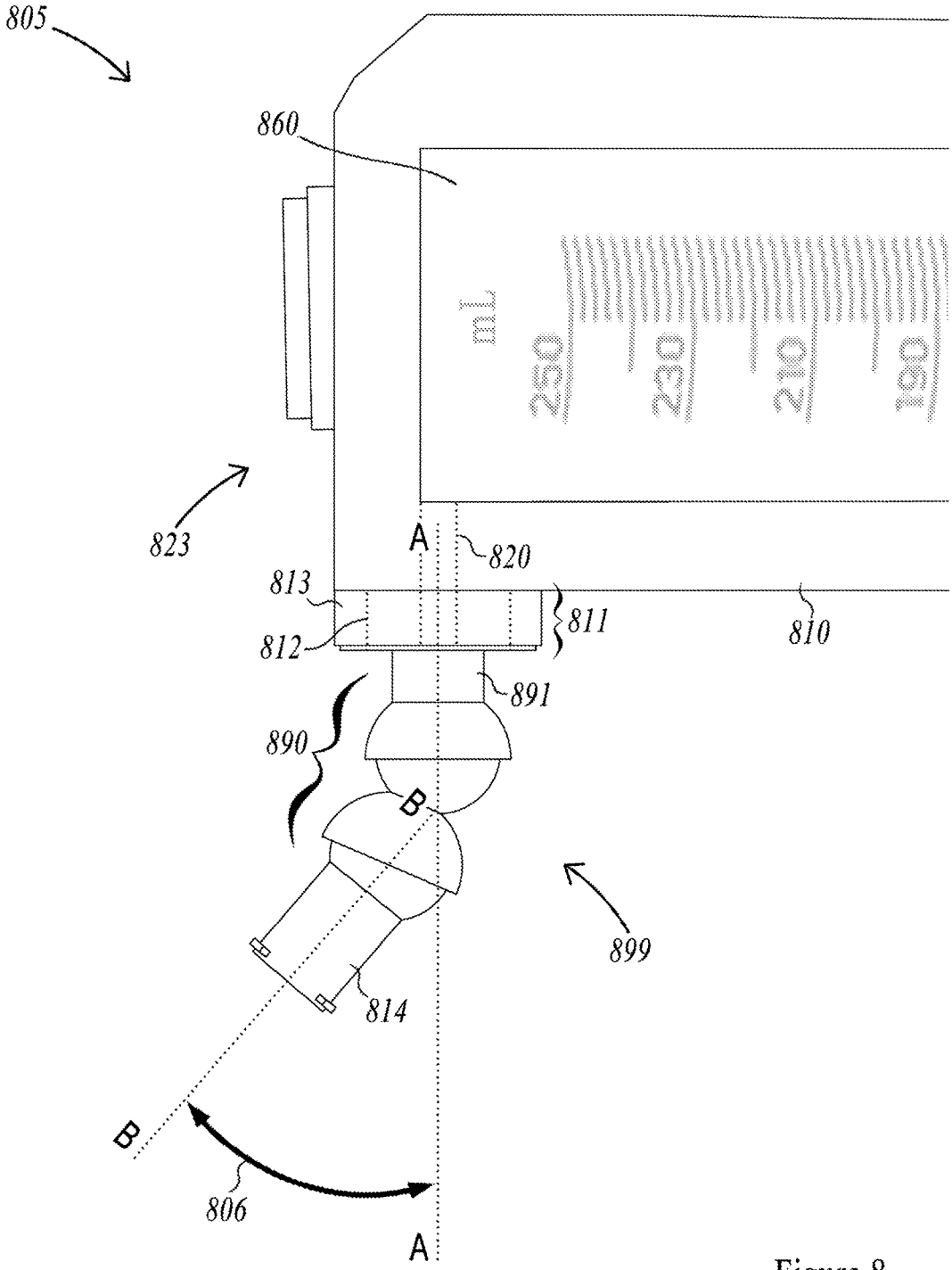
FIG. 8 illustrates a side view of an alternate embodiment of the bolus feeding device with extended, flexible dispensing unit.

FIG. 8 illustrates a side view of an alternate embodiment of the bolus feeding device with an extended, flexible dispensing unit. The device 805 comprises a chassis 810, chamber 860, chamber hatch 823, dispensing channel 820 and flexible, articulated dispensing unit 899. Similar to the previous embodiment, the flexible dispensing unit 899 extends downward from the chassis 810, comprising a rotation element 811 with outer ring 813 and inner ring 812. However, unique to this embodiment, is a flexible port connector. The proximal portion of the port connector, i.e. port connector base 891 is connected to the rotating inner ring 812 of the rotation element 811. The distal end of the port connector base 891 connects to a flexible joint 890 that in turn terminates in the port connector 814. The flexing portion 890 may be modular (as shown) or consist of a single flexing piece. The flexible dispensing unit 899 increases both the breadth of downward extension for the dispensing unit as well as its level of mobility and adaptability during feeding sessions. In particular, the flexible dispensing unit 899 minimizes twisting and kinking of the attached G-Tube. Dotted line "A" denotes the vertical axis or center-line of the rotation element 811 and port connector base 891. In a resting, or un-flexed state, the flexing portion 890 would be aligned with the vertical axis "A." The flexing or movement of the flexible dispenser 899 is indicated by motion arrow 806, wherein dotted line "B" is the rotated center-line or longitudinal axis of the port connector 814. As shown, the port connector 814 deviates from center-line "A" by an angle 806 corresponding to the degree of rotation (i.e. the angle formed between line "A" and "B"). The degree of rotation shown is exemplary and can be adjusted for optimal mobility and ease of use. This added range augments the 360 degree range of rotation around the vertical axis (e.g. line "A") already provided by the rotation element 811. The components in the dispensing unit are hollow and well-suited to channel liquid out of the chamber 860. Methods of attachment between the port connector base 891, flexing portion 890, and/or port connector 814 are carried out as known in the art.

Figure 9:
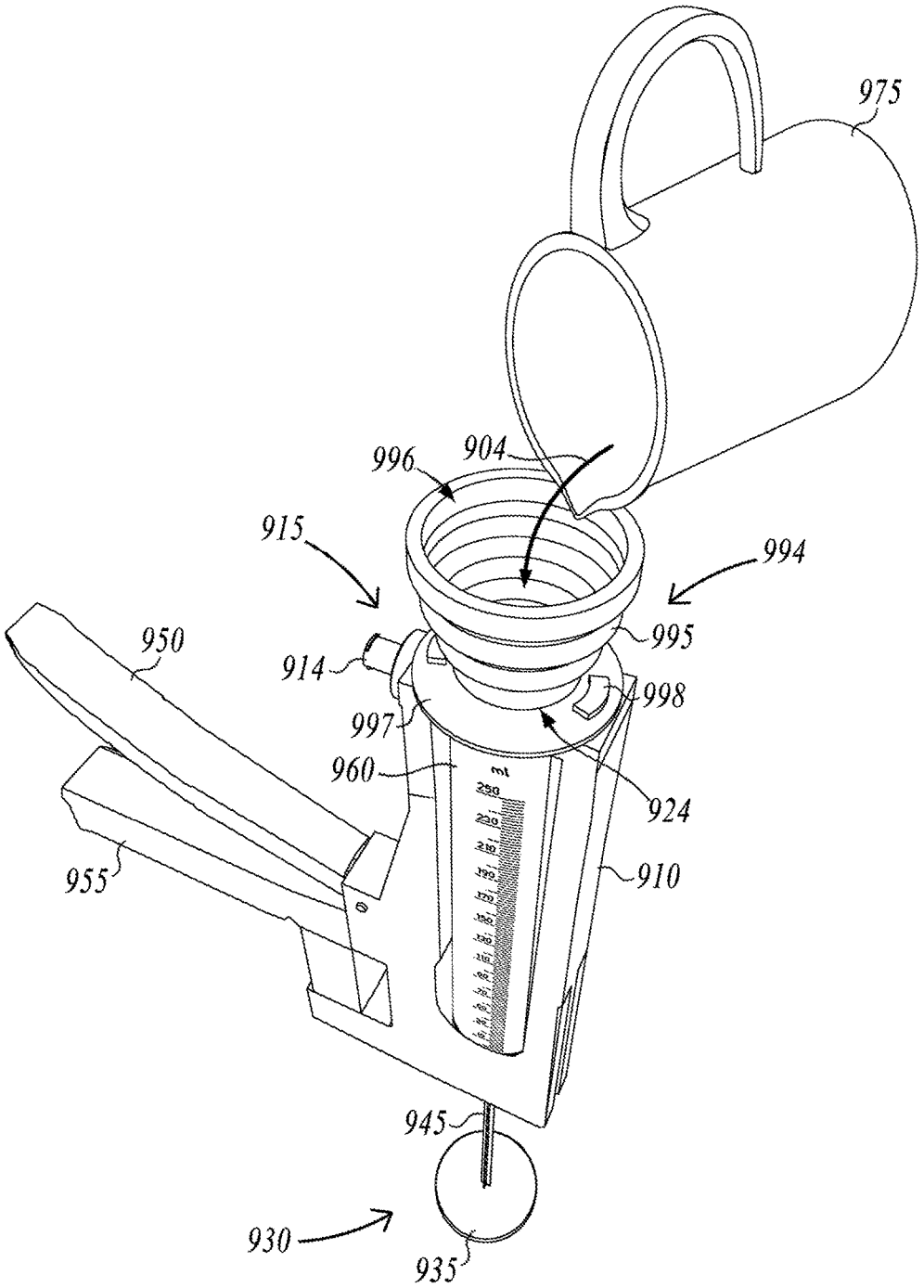
FIG. 9 illustrates a perspective view of an alternate embodiment of the bolus feeding device with expandable funnel for enhanced chamber loading.
Figure 10:
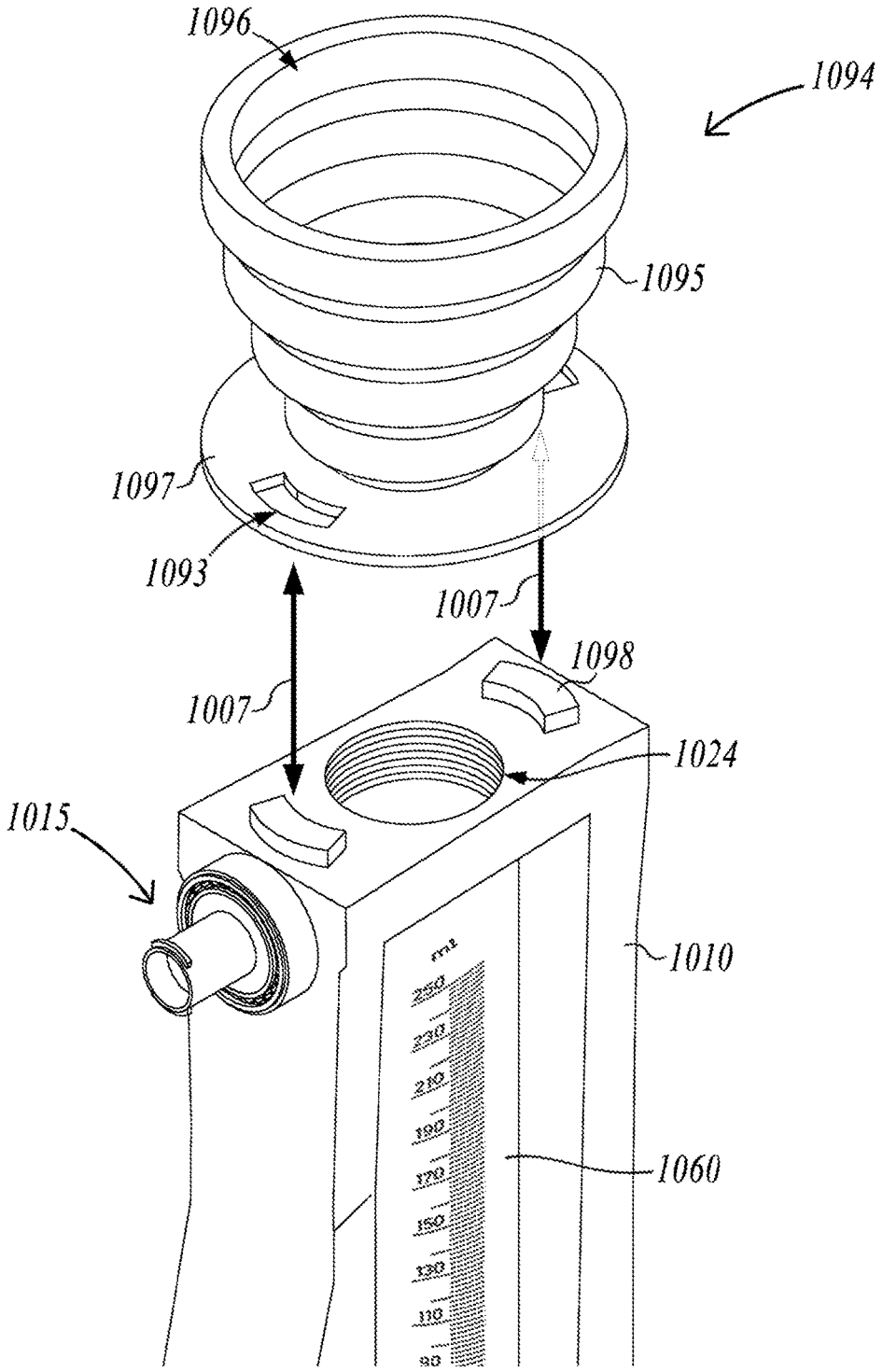
FIG. 10 illustrates an isometric view of the detached funnel unit.
Figure 11:
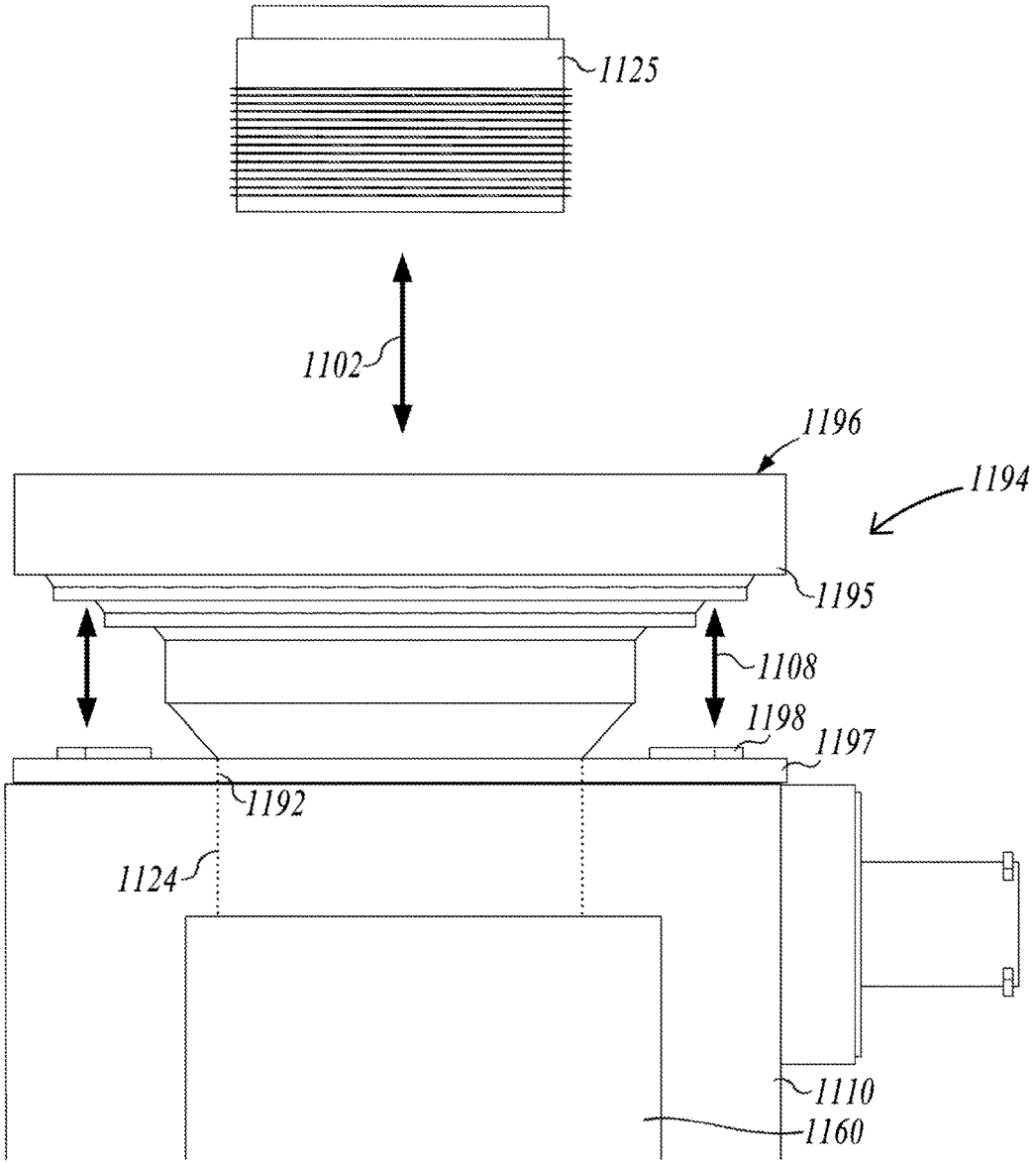
FIG. 11 illustrates a side view of funnel expansion/collapse and chamber cap removal/attachment.

FIGS. 9-11 illustrate an alternate embodiment of the bolus feeding device that features an expandable and detachable funnel unit that facilitates the filling of the chamber with the formula or bolus. FIG. 9 illustrates a perspective view of the bolus feeding device with expandable funnel unit 994 for enhanced chamber loading. FIG. 9 shows the channel being loaded with the bolus from a container 975. The funnel unit 994 comprises a base portion 997, expandable funnel portion 995, and funnel opening 996. To accommodate a detachable funnel unit 994, the bolus feeding device possesses connective protrusions 998 to engage with the funnel base portion 997. These protrusions extend outward from the chassis 910. The hole at the base of the funnel unit 994 (i.e. "funnel base hole") corresponds to (and is coextensive with) the chamber hole 924 of the bolus feeding device (as shown by funnel base hole 1192 in FIG. 11). Fluids may pass freely through the space created by said holes. Although not required, it is preferable to have the diameter of the funnel base hole equal the diameter of the chamber hole 924 (see funnel base hole 1192 in FIG. 11) because during chamber loading the liquid bolus would only contact the funnel before entering the chamber. However, if the funnel base hole were larger than the chamber hole 924 then the liquid bolus would contact the chassis 910, and if it were smaller than the chamber hole 924 then it would restrict the flow of liquid bolus into the chamber. This figure shows the funnel unit 994 in a fully expanded state, with the funnel's height is at its maximum level.

Prior to loading the chamber 960, as described in connection with FIG. 6, the user should pull the piston 930 out of the chamber 960, i.e. by pulling plunger base 935 until the majority of the plunger rod 945 resides outside of the chassis 910. With this action completed, the user can proceed to pour the contents of a formula-filled container 975 into the device's chamber 960 via motion arrow 904. The use of funnel unit 994 during this process enhances the accuracy and ease of chamber-loading, due to the greater opening size provided by the funnel relative to the chamber hole (as shown in FIG. 6). The funnel unit also reduces accidental spillage during chamber loading. Once the chamber loading is complete, the funnel 995 can be collapsed and the chamber cap is inserted, as shown in FIG. 11. For procedures such as chamber-loading, a flow valve may be utilized in the dispensing channel, or a port connector cap/cover may be utilized, as described above.

FIG. 10 illustrates an isometric view of the funnel 1094 detached from the chassis 1010. Detachment of the funnel unit 1094 may be desirable for a variety of reasons, but primarily for cleaning purposes. Removal of the funnel unit allows for more thorough cleaning of the chamber 1060, dispensing unit 1015, chassis 1010 as well as the funnel unit 1094 itself. However, normal operation does not require removal of the funnel unit 1094, as procedures such as chamber-loading, cleaning, etc. can all be performed with the funnel unit attached. To that end, the funnel unit 1094, with base portion 1097, expandable funnel 1095 and funnel opening 1096, possesses connective slits 1093. These openings in the base portion 1097 are configured to reversibly engage with the connective protrusions 1098 found on the chassis 1010. Motion arrows 1007 indicate the detachment or attachment of the funnel unit 1094 onto the connective protrusions 1098. Said detachment or attachment affected by a twisting motion that locks the funnel base 1097 into place on the chassis 1010. However, the reversible engagement of the funnel base to the chassis can take the form of other methods and mechanisms, such snap-on, screw-on, or slot-in-groove mechanisms.

FIG. 11 illustrates a side view of funnel expansion/collapse and chamber cap removal/attachment. The funnel unit 1194, comprising base portion 1197, expandable funnel 1195, and funnel opening 1196, is shown fully attached to the chassis 1110 via connective protrusions 1198. As indicated by motion arrows 1108, the funnel 1195 may be expanded or collapsed away from or towards the base portion 1197, respectively. The funnel 1195 may be constructed of a flexible polymer such as silicone. Having a silicone composition, or the like, the funnel's tiered ridges can collapse into one another, maintaining this collapsed state until the user deploys the funnel once again. As described in FIG. 10, the funnel unit 1194, although detachable, can capably remain in place for the duration of regular usage, without hindering other activities associated with operation of the bolus feeding device. By way of example, the chamber cap 1125 can be twisted onto, or off, the device, while the funnel unit 1194 is attached. The hole at the center of the base of the funnel, i.e. funnel base hole 1192, is aligned with the chamber hole 1124. With the chamber cap removed and the funnel unit 1194 in place, the user is able to insert a cleaning utensil into the interior chamber 1160 to cleaning purposes, such that removal of the funnel unit is not necessary. The chamber cap 1125 is inserted into the interior of the funnel and inserted into the chamber hole 1124, just as if the funnel unit 1194 were not attached. These features help to save the user time and discomfort during the otherwise difficult process of bolus feeding.

While there have been described herein what are considered to be preferred and exemplary embodiments of the present invention, other modifications of the invention shall be apparent to those skilled in the art from the teachings herein. It is noted that the embodiments disclosed are illustrative rather than limiting in nature and that a wide range of variations, modifications, changes, substitutions are contemplated in the foregoing disclosure and, in some instances, some features of the present invention may be employed without a corresponding use of other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

What is claimed is:

1. A bolus feeding device comprising:

a chassis that houses a chamber configured to store liquid, the chassis having a bottom surface, a distal surface, a proximal surface, and a top surface;

a piston slidably engaged with the chamber and the distal surface of the chassis, the piston further comprising a plunger tip, a plunger rod, and a plunger base, the piston positioned parallel to a longitudinal axis of the device, the piston and chamber having a smooth surface;

a handle that extends from a bottom surface of the chassis;

a trigger that extends from a bottom surface of the chassis, wherein pulling the trigger causes the piston to move towards the distal surface of the chassis;

a chamber hatch assembly located on a distal surface of the chassis, the chamber hatch assembly arranged axially along the longitudinal axis of the device, the chamber hatch assembly further comprising a chamber hole and a chamber cap that reversibly seals the chamber hole;

a dispensing unit positioned perpendicular to a longitudinal axis of the device, the dispensing unit extending from a bottom surface of the chassis, the dispensing unit further comprising an inner ring, an outer ring, and a port connector, the dispensing unit adapted to dispense fluid;

a dispensing channel that connects the chamber to the dispensing unit; and a tube in fluid connection with the dispensing unit, the tube having a proximal end positioned perpendicular to the piston and axially with the port connector, wherein the tube is adapted to dispense fluid;

wherein the port connector has a proximal end and a distal end;

wherein the proximal end of the port connector is rigidly affixed to the inner ring, the outer ring is rigidly affixed to the chassis, the inner ring is rotatably connected with the outer ring, and the distal end of the port connector is free, such that the port connector is able to rotate about a vertical axis; and wherein the chamber is filled from the distal surface through the chamber hatch assembly and dispensed from the bottom surface through the dispensing unit.

2. The bolus feeding device of claim 1, further comprising a detachable funnel unit that is attached to the chassis and centered over the chamber hatch assembly, the funnel unit further comprising a funnel base, a funnel base hole, an expandable funnel, and a funnel opening.

3. The bolus feeding device of claim 1, wherein the port connector is connected to the inner ring via a flexible joint that allows the port connector to rotate, such that the center line of the inner ring and the center line of the port connector can be separated by an angle corresponding to the rotation.

4. The bolus feeding device of claim 3, wherein the inner ring of the dispensing unit is rotatably connected to the outer ring of the dispensing unit via a radial ball bearing.

5. The bolus feeding device of claim 1, wherein said dispensing channel further comprises a pressure sensitive flow valve that is only open when the chamber is pressurized via the compression of the trigger.

6. A bolus feeding device comprising:

a chassis that houses a chamber configured to store liquid, the chassis having a bottom surface, a distal surface, a proximal surface, and a top surface;

a piston slidably engaged with the chamber and the distal surface of the chassis, the piston further comprising a plunger tip, a plunger rod, and a plunger base, the piston positioned parallel to a longitudinal axis of the device, the piston and chamber having a smooth surface;

a handle that extends from a bottom surface of the chassis;

a trigger that extends from a bottom surface of the chassis, wherein pulling the trigger causes the piston to move towards the distal surface of the chassis;

a chamber hatch assembly located on the chassis, the chamber hatch assembly arranged axially along the longitudinal axis of the device, the chamber hatch assembly further comprising a chamber hole and a chamber cap that reversibly seals the chamber hole; a dispensing unit attached to the chassis and positioned perpendicular to a longitudinal axis of the device, the dispensing unit further comprising an inner ring, an outer ring, and a port connector, the dispensing unit adapted to dispense fluid; and a tube in fluid connection with the dispensing unit, the tube having a proximal end positioned perpendicular to the piston and axially with the port connector, wherein the tube is adapted to dispense fluid;

wherein the port connector has a proximal end and a distal end; wherein the proximal end of the port connector is rigidly affixed to the inner ring, the outer ring is rigidly affixed to the chassis, the inner ring is rotatably connected with the outer ring, and the distal end of the port connector is free, such that the port connector is able to rotate about a vertical axis; and a dispensing channel that connects the chamber to the dispensing unit.

7. The bolus feeding device of claim 6, further comprising a detachable funnel unit that is attached to the chassis and centered over the chamber hatch assembly, the funnel unit further comprising a funnel base, a funnel base hole, an expandable funnel, and a funnel opening.

8. The bolus feeding device of claim 6, wherein the port connector is connected to the inner ring via a flexible joint that allows the port connector to rotate, such that the center line of the inner ring and the center line of the port connector can be separated by an angle corresponding to the rotation.

9. The bolus feeding device of claim 8, wherein the inner ring of the dispensing unit is rotatably connected to the outer ring of the dispensing unit via a radial ball bearing.

10. The bolus feeding device of claim 6, wherein said dispensing channel further comprises a pressure sensitive flow valve that is only open when the chamber is pressurized via the compression of the trigger.

11. A bolus feeding device comprising: a chassis that houses a chamber configured to store liquid, the chassis having a bottom surface, a distal surface, a proximal surface, and a top surface;

a piston slidably engaged with the chamber, the piston further comprising a plunger tip, a plunger rod, and a plunger base, the piston positioned parallel to a longitudinal axis of the device, the piston and chamber having a smooth surface;

a handle that extends from a bottom surface of the chassis;

a trigger that extends from a bottom surface of the chassis, wherein pulling the trigger causes the piston to move towards the distal surface of the chassis;

a chamber hatch assembly located on a distal surface of the chassis, the chamber hatch assembly arranged axially along the longitudinal axis of the device, the chamber hatch assembly further comprising a chamber hole and a chamber cap that reversibly seals the chamber hole;

a port connector that is connected to the chassis;

a dispensing channel that connects the chamber to the port connector; and a tube in fluid connection with the dispensing chamber, the tube having a proximal end positioned perpendicular to the piston and axially with the port connector, wherein the tube is adapted to dispense fluid.

12. The bolus feeding device of claim 11, further comprising a detachable funnel unit connected to the distal surface of the chassis, the funnel unit further comprising a funnel base, a funnel base hole, an expandable funnel, and a funnel opening.

13. The bolus feeding device of claim 11, further comprising a dispensing unit positioned perpendicular to a longitudinal axis of the device, wherein the chamber hatch and dispensing unit are on different surfaces of the chassis, the dispensing unit adapted to dispense fluid.

14. The bolus feeding device of claim 11, further comprising a dispensing unit, wherein the chamber hatch and dispensing unit are on the same surface of the chassis, the dispensing unit adapted to dispense fluid.

15. The bolus feeding device of claim 11, wherein said dispensing channel further comprises a pressure sensitive flow valve that is only open when the chamber is pressurized via the compression of the trigger.

* * * * *